United States Patent [19]

Musgrave

[11] 4,120,109

[45] Oct. 17, 1978

[54] EXTENDED MAGAZINE HOLDER

[76] Inventor: Daniel Dennis Musgrave, 8201 Caraway St., Cabin John, Md. 20731

[21] Appl. No.: 821,246

[22] Filed: Aug. 2, 1977

[51] Int. Cl.[2] ..... F41C 27/00

[52] U.S. Cl. ..... 42/90

[58] Field of Search ..... 42/90, 88, 87, 1 R, 42/50, 18, 1 MH, 71–72; 224/5 MC, 15, 21

[56] References Cited

U.S. PATENT DOCUMENTS

| | | | |
|---|---|---|---|
| 2,324,125 | 7/1943 | Van Horn et al. | 42/72 |
| 2,931,120 | 4/1960 | Kolin | 42/18 |
| 3,260,008 | 7/1966 | Yeomans, Jr. | 42/1 MH |
| 3,982,676 | 9/1976 | Bourlet | 42/90 |

FOREIGN PATENT DOCUMENTS

| | | | |
|---|---|---|---|
| 860,876 | 10/1940 | France | 42/88 |
| 556,961 | 2/1957 | Italy | 224/21 |

*Primary Examiner*—Charles T. Jordan

[57] ABSTRACT

A device for holding a cartridge magazine in an extended position and properly oriented for easy insertion into a firearm. The holder can be supported on the person of a user or it can be mounted on a structure which might be part of a vehicle, a boat, or an aircraft. The magazine can be quickly snatched from the holder by hand, or it can be inserted by moving the firearm so as to encompass the magazine, which can then be removed from the holder by moving the firearm.

7 Claims, 8 Drawing Figures

EXTENDED MAGAZINE HOLDER

Many firearms use detachable magazines which are removed when empty and replaced by similar, full magazines. This requires a significant amount of time to accomplish, and usually two hands must be employed in making the exchange. Situations sometimes occur in which only one hand is free for this purpose, and it may also happen that a reduction of the elapsed time for completing the exchange is of critical importance.

The primary object of this invention is to provide a magazine holder which can releasably hold a magazine in an attitude and an orientation that will expedite insertion of the magazine into a receptacle in a firearm.

Another object is to provide variations in details of such a magazine holder, to adapt it for use with various types of magazines.

Another object is to provide a holder which is convenient for use by both right-handed and left-handed persons.

These and other objects of the present invention will be apparent upon reference to the following specification, taken in conjunction with the accompanying drawings, wherein.

The illustrations have been selected only as a convenience for purposes of disclosure and they are not intended as limitations on the invention. In actual practice, it might be necessary to vary the details of the holder to adapt it to various magazines, or to the situation in which it is to be used.

Figure 1:
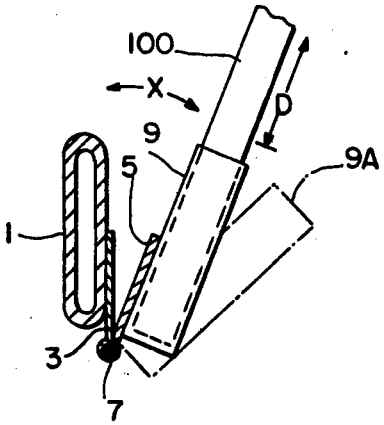
FIG. 1 is a side view of a magazine holder hinged to a supporting structure.

Referring to the drawings FIG. 1 shows a magazine holder carried on a supporting structure which happens to be a belt loop 1. The loop is adapted to be suspended from the person of a user in the well-known manner. The loop is used only as a convenient example for purposes of disclosure, and it is apparent that various other well-known mechanical devices could serve as the supporting structure.

Fixed to loop 1 is a hinge comprising a first plate 3, a second plate 5, and a hinge pin 7. The plates have the usual type of loops for engaging the pin.

Fixed to plate 5 is a socket 9, having internal dimensions and configuration so chosen as to be adapted for encompassing the lower portion of a magazine 100, which is shown protruding from the upper, open end of the socket. The dimensions line "D" near the magazine is to indicate what portion of said magazine is inserted into a receptacle on a firearm when the magazine is put to use. It will be noted that in this instance dimension D does not include any of the portion of the magazine which is inserted into the socket.

The socket is allowed only a limited angular movement relative to loop 1, as indicated by the curved arrow "X" in FIG. 1. This limit can be designed into the hinge in the well-known manner. When not in use, the socket can be pivoted against the loop and retained there by some simple type of latch, which is not shown on the drawing.

If it is desired to carry more than one magazine in a holder, a second socket 9A can be provided. It can be arranged on a hinge so as to be allowed a different angular movement relative to loop 1, so that the two magazines will be supported at different attitudes, which will make each magazine easily accessible for removal from the holder.

Socket 9 in FIG. 1 may retain the magazine therein by friction, that is by having the socket closely contoured to encompass the magazine. If the magazine is made of some magnetic material, the socket could be made as a magnet, thus using magnetic attraction to retain the magazine therein. Obviously, the arrangement could be vice-versa.

Figure 2:
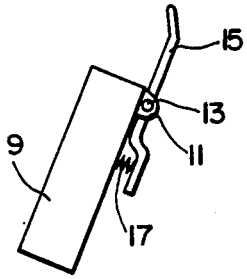
FIG. 2 is an alternate construction for a portion of FIG. 1.

FIG. 2 shows an alternate arrangement for retaining a magazine in the socket. Socket 9 has a bracket 11 mounted thereon. The bracket supports a pin 13 on which is pivoted a lever 15, biased by a spring 17 reacting against the exterior of the socket. It is readily apparent that the end of the lever can bear against a magazine in the socket and thus retain it therein. If desired, more than one lever could be so used. In effect, such levers constitute spring loaded jaws.

Of course, the dimensions of the socket and the lever must be so chosen as to not contact a magazine at a location so as to interfere with complete insertion of said magazine into a receptable on a firearm.

Figure 3:
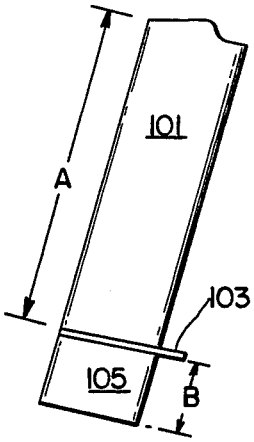
FIG. 3 is a view of a firearm magazine having an extension to engage with a magazine holder.

Some magazines, such as that shown in FIG. 3, are inserted almost completely into a firearm when in use. Magazine 101 in FIG. 3 is thus inserted a distance equal to dimension line "A", leaving only floor plate 103 outside the receptacle. To provide means to support this magazine in a holder such as that shown in FIG. 1, an extension 105 can be affixed below the floor in any convenient manner. The extension is dimensioned and shaped so as to be capable of being inserted into socket 9 a suitable distance as indicated by dimension line "B". The location of the extension relative to the magazine is so chosen that the magazine can be fully inserted into a firearm while the extension is inserted into socket 9.

Figure 4:
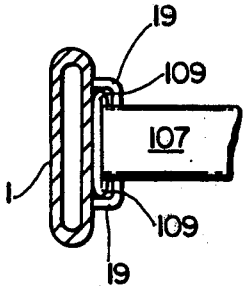
FIG. 4 is a side view of another type of magazine holder.

Another type of magazine is shown in FIG. 4. Magazine 107 has a floor plate 109 which extends slightly beyond each side wall of the magazine. In FIG. 4 two members 19 are fixed to belt loop 1 to form a T-slot. The magazine can be supported in an extended manner by engaging the floor plate in the T-slot as shown in FIG. 4. When it is desired to disengage the magazine it can be caused to slide out of the T-slot. The arrangement shown in FIG. 4 can be used by moving the firearm so as to encompass the extended magazine, if the portion of the magazine embraced by members 19 is not required to enter the magazine receptacle on the firearm.

Figure 5:
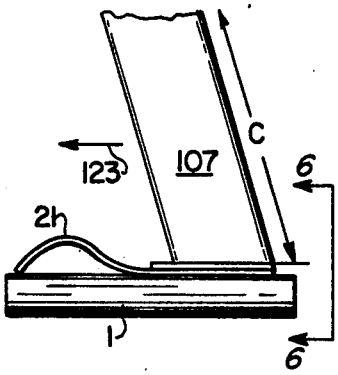
FIG. 5 is a top view of a holder slightly different from that shown in FIG. 4.
Figure 6:
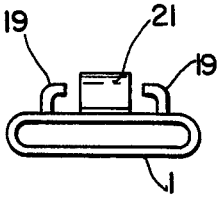
FIG. 6 is an end view of the holder shown in FIG. 5 as indicated by line 6—6 on FIG. 5.

If such a magazine must be inserted into the firearm with only the floor plate outside the receptacle, the arrangement disclosed in FIGS. 5 and 6 may be used. Magazine 107 is here required to be inserted a distance indicated by dimension line "C".

As shown in FIG. 6, two members 19 form a T-slot. In FIG. 5 the nearer of the two is not shown, for purpose of clarity. The T-slot is mounted on loop 1, and fixed to the loop in any convenient manner is a flexible cam 21.

The magazine in FIG. 5 is supported in the T-slot. When it is desired to remove it the firearm is moved so as to encompass the magazine. It is then moved in the direction indicated by arrow 123, thus sliding the floor of the magazine along the flexible cam 21. As soon as the floor plate clears the T-slot, the cam will exert an upward thrust and fully seat the magazine in the receptacle on the firearm.

Figure 7:
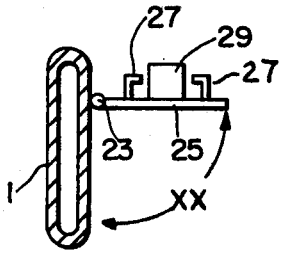
FIG. 7 shows an alternate detail for FIG. 4.

Obviously, the arrangements shown in FIGS. 4, 5 and 6 would be inconvenient in that a magazine would protrude horizontally from the belt loop. As shown in FIG. 7 the T-slot could be hinged relative to the belt loop. Members 27 and 29 are mounted on plate 25 which is pivotable at joint 23 on loop 1. Curved arrow "XX" indicates such a pivotable capability. A latach (not shown) can be provided to keep in the position in which it is shown in FIG. 7.

Figure 8:
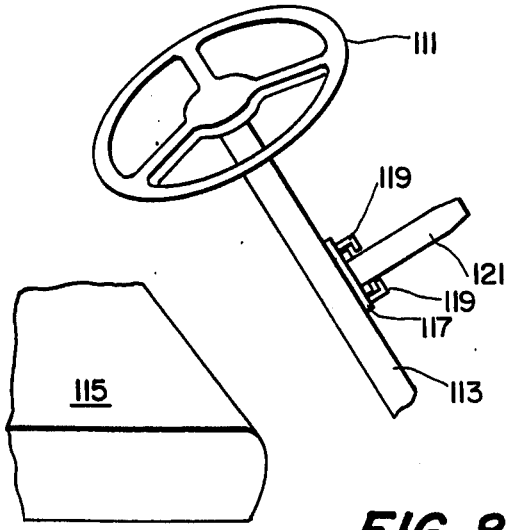
FIG. 8 shows a portion of a human transportation conveyance having an extended magazine holder mounted thereon.

FIG. 8 shows an extended magazine holder mounted on a conveyance, which might be a land vehicle, a boat, or an aircraft. A steering wheel 111 is mounted on a control column 113 near a driver's seat 115. Fixed to the column is a base 117 having two members 119, which, with the base from a T-slot. In the T-slot is positioned a magazine 121, having a floor plate capable of engaging the T-slot. When required the magazine can be removed by sliding it out of the T-slot.

Although the extended magazine holder shown in FIG. 8 happens to be similar to that shown in FIG. 4, it is apparent that various types of magazine holders could be mounted on such a conveyance.

It is desired to point out that the method of mounting the extended magazine holders on the supporting structure may vary depending upon circumstances. In some instances, such as that shown in FIG. 8, rigid mounting will suffice. If rigid mounting in the extended position is not desirable, a movable mounting can be used. Many different mechanical arrangements can be used to meet various conditions encountered in service. The magazine holder might be suspended from the person of the user, or it might be mounted on some inanimate object, such as a human-transportation conveyance.

In operation, the extended magazine holders can be used in two ways. Assuming a magazine to be held in an extended position, as in FIG. 1, the user can snatch the magazine from the holder and insert it into his firearm. Presumably, one hand would be holding the firearm, so this method requires the use of two hands.

If only one hand is to be used, (it being the one holding the firearm) the firearm can be moved so that its magazine receptacle encompasses the magazine to such a depth that the magazine latches therein. The magazine is then removed from the holder by moving the firearm. The direction of said movement will be determined by the type of holder.

The holders disclosed herein can be used by either right-handed or left-handed persons, by simply inserting the magazines into the holders in the proper orientation.

The magazines shown in the drawings were selected only for convenience in disclosing the invention. It is not intended to limit the utility of the invention to any class of magazines, or class of firearms.

There is thus disclosed a magazine holder which can support a cartridge magazine in an extended manner in an attitude most convenient for insertion into a receptacle in a firearm. It is desired to point out that the disclosure is exemplary, and that in actual practice modifications may be made in details of the holder. Furthermore, the holder may be installed in a cover or pouch to protect the contents in the well-known manner.

What I claim is:

1. A device for holding a cartridge magazine in an extended position comprising releaseable means adapted for engagement with said magazine near a base of said magazine and a structure supported on the person of a user and positionally adapted for support of said means, said means being adapted for said engagement while said magazine is inserted into a magazine receptacle of a firearm.

2. A device as set forth in claim 1 wherein said means comprises a socket adapted to encompass said magazine near a base of said magazine.

3. A device as set forth in claim 2 wherein said socket includes frictional means positionally adapted for retarding withdrawal of said magazine from said socket.

4. A device as set forth in claim 3 wherein said frictional means includes at least one spring-biased jaw.

5. A device as set forth in claim 2 wherein said means comprises a plurality of sockets, each socket being adapted for a different amount of movement relative to said structure.

6. A device as set forth in claim 1 wherein said means is adapted for disengagement from said magazine while said magazine is inserted into a magazine receptacle of a firearm.

7. A device for holding a cartridge magazine in an extended position comprising releaseable means adapted for engagement with a base of said magazine and a structure supported on the person of a user and positionally adapted for support of said means, said means being adapted for said engagement while said magazine is inserted into a magazine receptacle of a firearm.

* * * * *